US006351869B1

(12) United States Patent
Jones

(10) Patent No.: US 6,351,869 B1
(45) **Date of Patent: *Mar. 5, 2002**

(54) SYSTEM FOR SUPPORTING A TOWEL

(76) Inventor: Gwenn L. Jones, 744-A Linden Ave., Burlingame, CA (US) 94010

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/275,526

(22) Filed: Mar. 24, 1999

(51) Int. Cl.[7] ..... A47L 13/16

(52) U.S. Cl. ..... 15/209.1; 24/3.1; 24/114.6; 2/266; 2/271; 428/131; 428/136

(58) Field of Search ..... 15/208, 209.1, 15/222; 2/265, 266, 271; 24/3.1, 3.13, 114.4, 114.6; 428/102, 131, 134, 136

(56) References Cited

U.S. PATENT DOCUMENTS

| | | | | | |
|---|---|---|---|---|---|
| 368,035 | A | * | 8/1887 | Wentworth | 2/266 |
| 423,327 | A | * | 3/1890 | Keeler | 2/265 X |
| 1,478,112 | A | * | 12/1923 | Flather | 15/209.1 |
| 1,990,568 | A | * | 2/1935 | Scheidler | 15/222 |
| 2,020,170 | A | * | 11/1935 | Borroughs | 15/208 X |
| 2,204,947 | A | * | 6/1940 | Apfelbaum | 15/208 |
| 2,318,295 | A | * | 5/1943 | Davidow | 2/266 X |
| 2,524,192 | A | * | 10/1950 | Herget | 15/120.1 X |
| 2,544,354 | A | * | 3/1951 | Reiter | 15/222 |
| 2,754,532 | A | * | 7/1956 | Kanehl et al. | 15/209.1 |
| 2,803,845 | A | * | 8/1957 | Bradford | 15/209.1 |
| 3,536,554 | A | * | 10/1970 | Weiss | 2/266 X |
| 3,760,461 | A | * | 9/1973 | Wright | 15/209.1 X |
| 4,224,712 | A | * | 9/1980 | Black et al. | 15/209.1 |
| 4,403,366 | A | * | 9/1983 | Lucke | 15/209.1 |
| 4,516,616 | A | * | 5/1985 | Fesler | 15/209.1 X |
| 4,565,144 | A | * | 1/1986 | Ricci | 15/222 |
| 4,771,502 | A | * | 9/1988 | Trimble | 15/209.1 |

FOREIGN PATENT DOCUMENTS

| | | | | |
|---|---|---|---|---|
| FR | 2399229 | * | 3/1979 | 15/209.1 |
| GB | 245697 | * | 1/1926 | 15/208 |
| GB | 597275 | * | 1/1948 | 2/266 |

* cited by examiner

*Primary Examiner*—Mark Spisich
(74) *Attorney, Agent, or Firm*—Squire, Sanders & Dempsey, L.L.P.

(57) ABSTRACT

A towel has a towel-supporting aperture and a soft reinforcing device for reinforcing the towel-supporting aperture. The towel can be placed over a hook through the aperture. Thus, the towel will not slide off the hook. The aperture can include a hole in the towel or a loop connected to the towel, and can be disposed within a border region, within a design region or within a bulk region of the towel. Examples of the soft reinforcing device include fabric, stitching, plastic, rubber and glue.

5 Claims, 6 Drawing Sheets

SYSTEM FOR SUPPORTING A TOWEL

BACKGROUND OF THE INVENTION

1. Field of the Invention

This invention relates generally to towels, and more particularly provides a system for supporting a towel.

2. Description of the Background Art

FIG. 1 illustrates a conventional towel 100. The term "towel" is being used herein to include any cloth that can be used for wiping or drying. Examples of towels 100 include beach towels, face towels, wash cloths, car towels, kitchen towels, etc. The conventional towel 100 includes a border region 105, bulk regions 110 and design regions 115. Each region 105, 110 and 115 is typically designed and manufactured using the same thread, but using a different pattern and stitch. Bulk region 110 is typically designed and manufactured using a terry cloth.

Typically, towels 100 are dangled over a towel hook or draped over a towel bar, for example, in a bathroom or in a kitchen. However, towel hooks do not adequately support towels 100, as towels 100 often slide off, and can puncture towels 100 with little pressure. Towel bars take up substantial amounts of wall space and are tedious to use, especially when trying to drape an oversized body towel 100.

Some rags used at automotive repair shops have corner-disposed holes reinforced by annular metal rings. However, the annular metal rings render these rags unsuitable for drying or wiping sensitive surfaces such as skin or paint.

Therefore, a more supportive towel-suspension system for towels that can be used for sensitive surfaces is needed.

SUMMARY OF THE INVENTION

A towel has a towel-supporting aperture and a soft reinforcing device for reinforcing the towel-supporting aperture. The towel can be placed over a hook through the aperture. Thus, the towel will not slide off the hook. The aperture can include a hole in the towel or a loop connected to the towel, and can be disposed within a border region, within a design region or within a bulk region of the towel. Examples of the soft reinforcing device include fabric, stitching, plastic, rubber and glue.

A first method of manufacturing a towel includes obtaining a towel, forming an aperture through the towel, and disposing a soft reinforcing device for reinforcing the aperture.

A second method of manufacturing a towel includes obtaining a towel, and connecting a soft towel-supporting mechanism to the towel.

DETAILED DESCRIPTION OF THE PREFERRED EMBODIMENT

Figure 1:
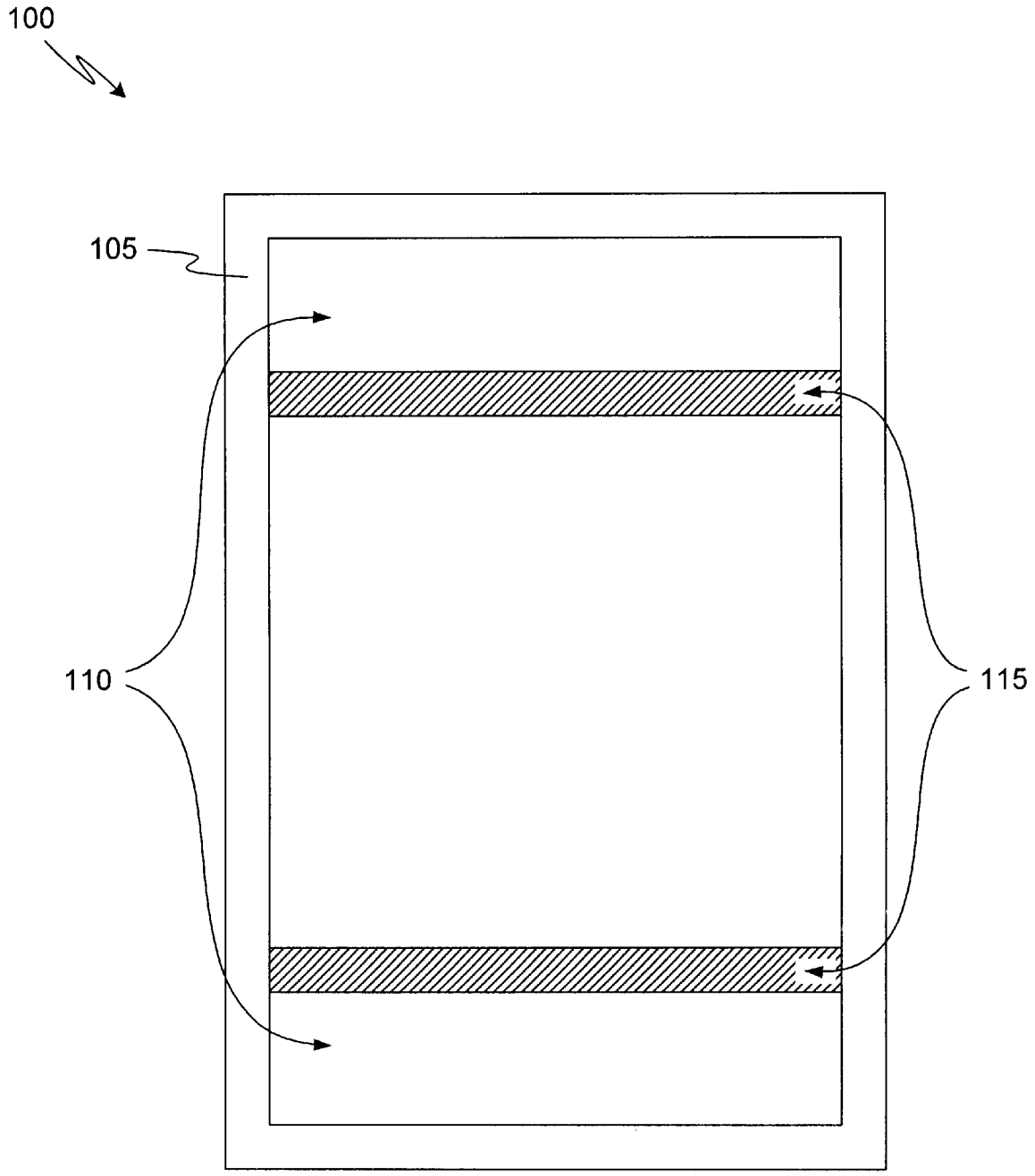
FIG. 1 (PRIOR ART)
FIG. 1 illustrates a prior art towel.
Figure 2:
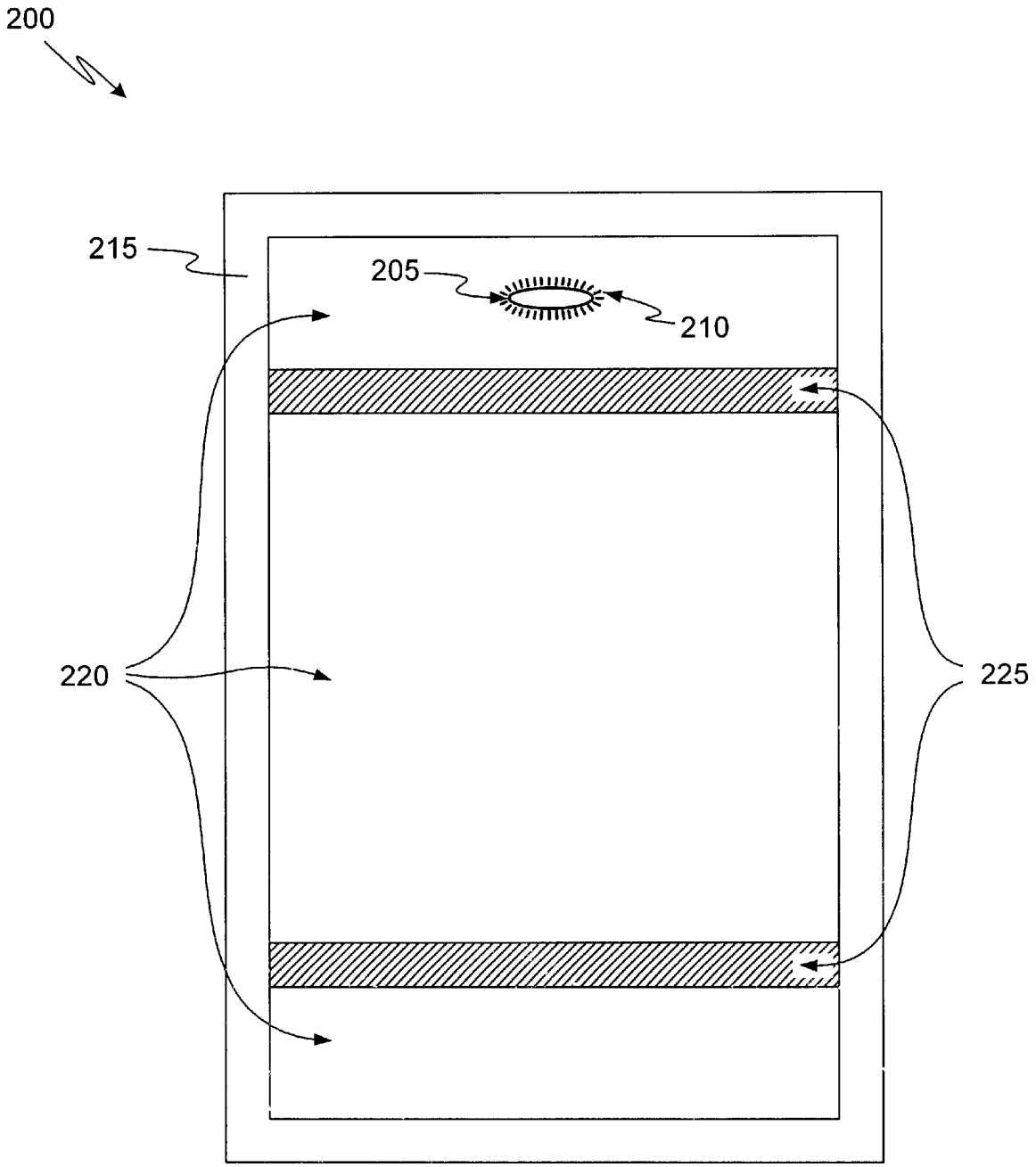
FIG. 2 illustrates a first towel-support mechanism.

FIG. 2 illustrates an example towel 200, in a first embodiment. The towel 200 includes a towel-supporting aperture

205 with reinforcing stitching 210 about the aperture 205. The aperture 205 and reinforcing stitching 210 can be made with a simple sewing apparatus buttonholer. The aperture 205 can be of any shape. The reinforcing stitching 210 preferably includes heavy-duty thread.

Figure 3:
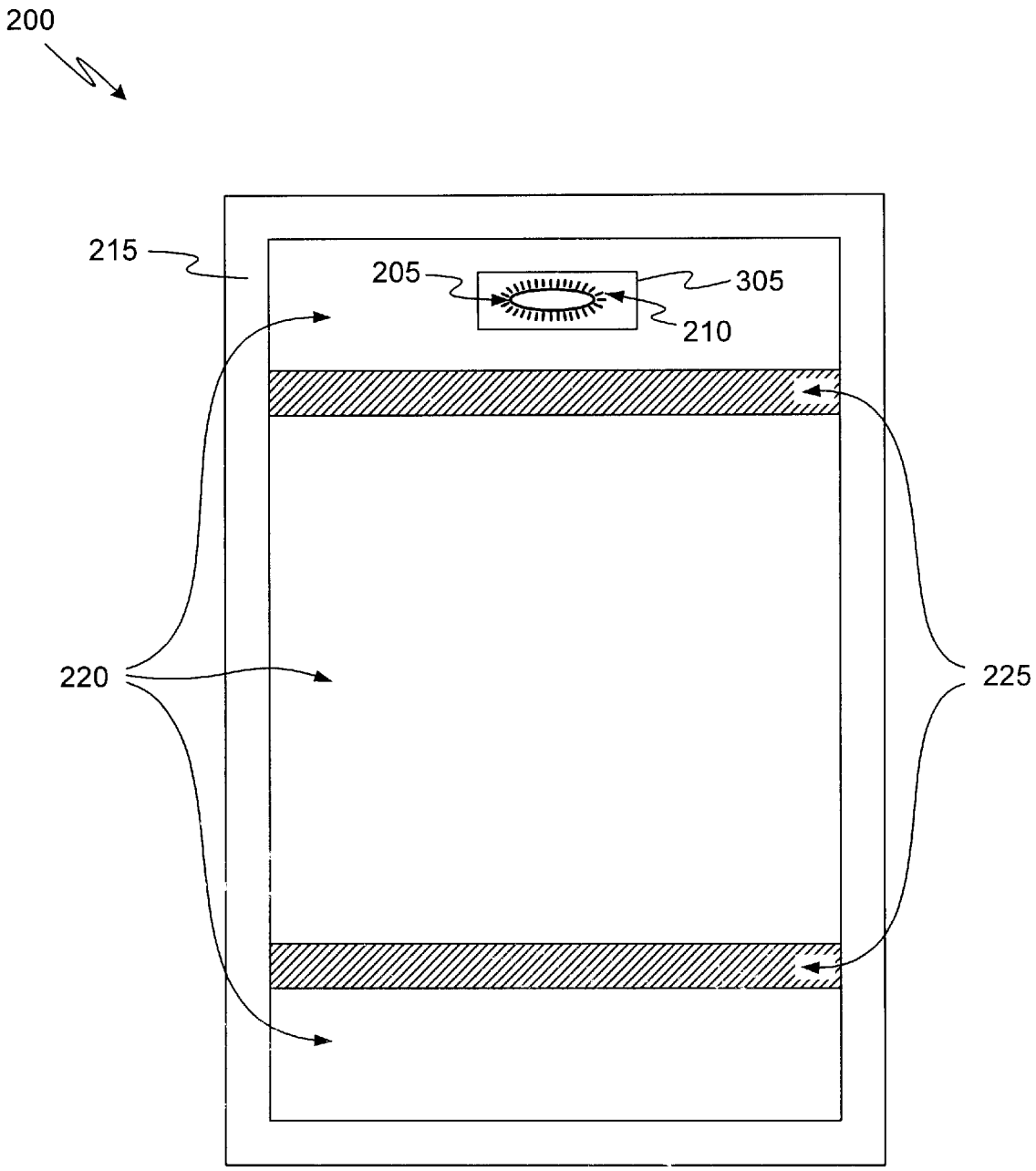
FIG. 3 illustrates a second towel-support mechanism.

It will be appreciated that, instead of reinforcing stitching 210, any soft reinforcing device such as soft plastic, soft rubber, glue, additional fabric layers, etc. can additionally or alternatively be used. For example, the aperture 205 can be made through an applique or through stabilizing fabric sewn on the towel 200. For example, FIG. 3 illustrates a towel 300 in a second embodiment, which includes an aperture 205 and reinforcing fabric 305 disposed about the aperture 205. The soft reinforcing device can be placed anywhere about or adjacent the aperture 205, so long as it provides support to the aperture 205 and/or surrounding material. The soft reinforcing device preferably supports its own weight and some additional weight.

It will be further appreciated that the location of the aperture 205 is not critical. The aperture 205 may be disposed within a border region 215, within a bulk region 220, within a design region 225 or within any other region of the towel 200. It will be appreciated that the different regions 215, 220 and 225 of the towel 200 may be made of various threads, patterns and stitches. It will be further appreciated that the aperture 205 will fray less if placed within a region 215, 220 or 225 that uses heavier weight thread and/or a tighter stitch, e.g., within the design region 225 or within the border 215.

Figure 4:
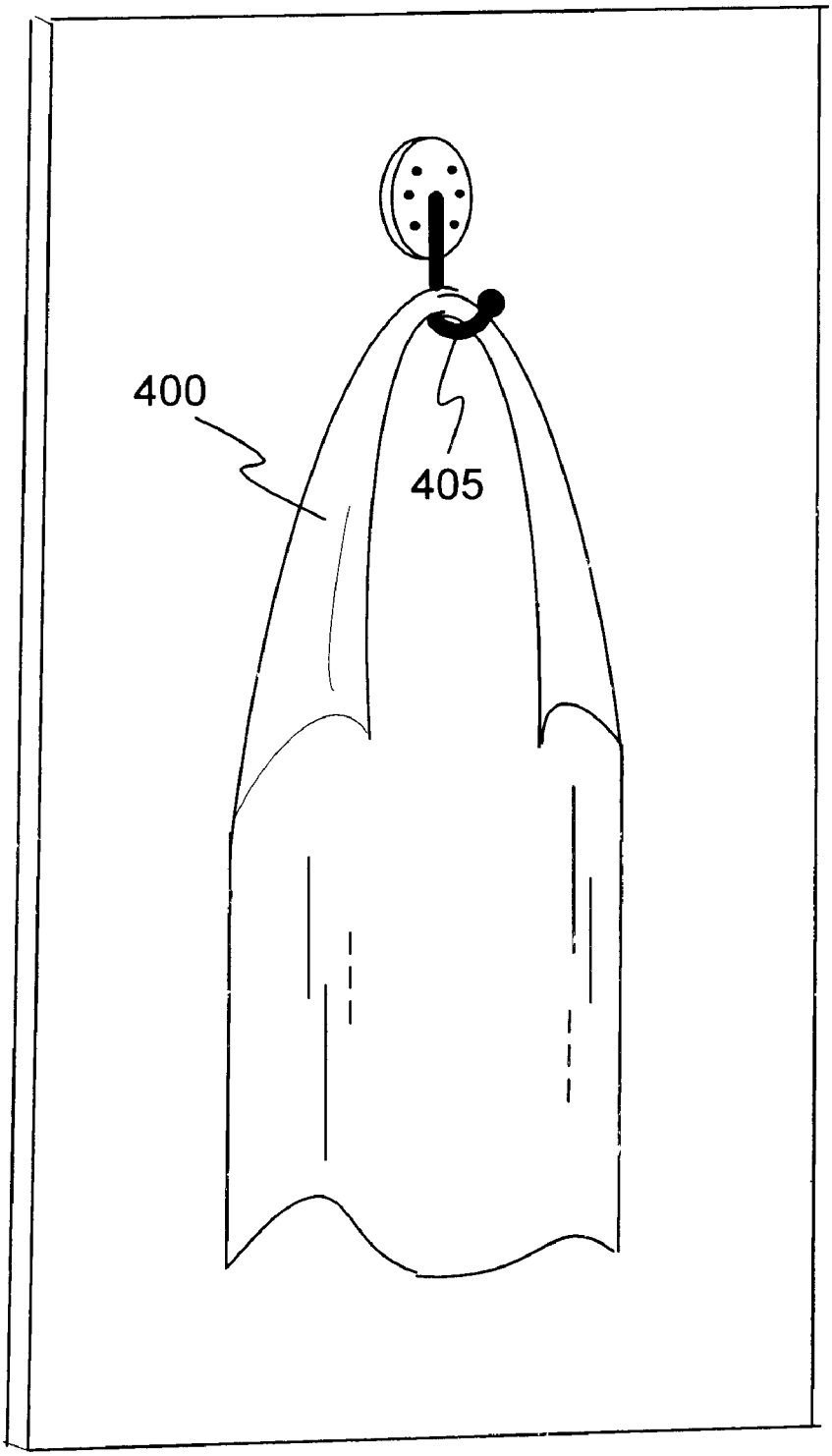
FIG. 4 illustrates a towel having an aperture and being supported by a hook.

FIG. 4 illustrates a towel 400 (which may be, for example, towel 200 or 300) hanging on a hook 405. The aperture 205 (not shown in FIG. 4) of towel 400 is preferably sufficiently large to slide over the hook 405. It will be appreciated that the towel 400 will not slide unwantedly off the hook 405.

Figure 5:
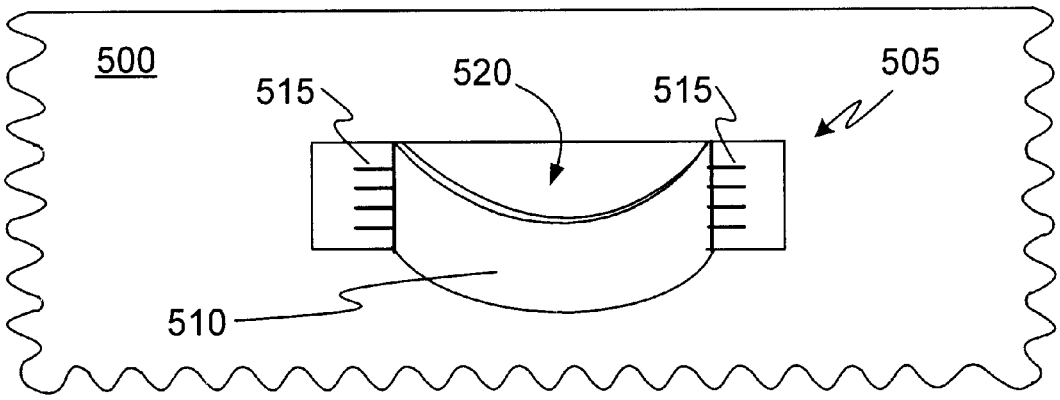
FIG. 5 illustrates a third towel-support mechanism.

FIG. 5 illustrates a towel-supporting mechanism 505 on a towel 500, in a third embodiment. In this embodiment, the towel-supporting mechanism 505 includes a loop 510 forming an aperture 520 and reinforcing stitching 515 on both sides of the loop 510. The loop 510 may be disposed in a border region, 215, in a bulk region 220 or in a design region 225 of the towel 500. It will be appreciated that, instead of reinforcing stitching 515, any soft reinforcing device, such as fabric, plastic, rubber or glue disposed about or adjacent to the loop 510, can additionally or alternatively be used.

Figure 6:
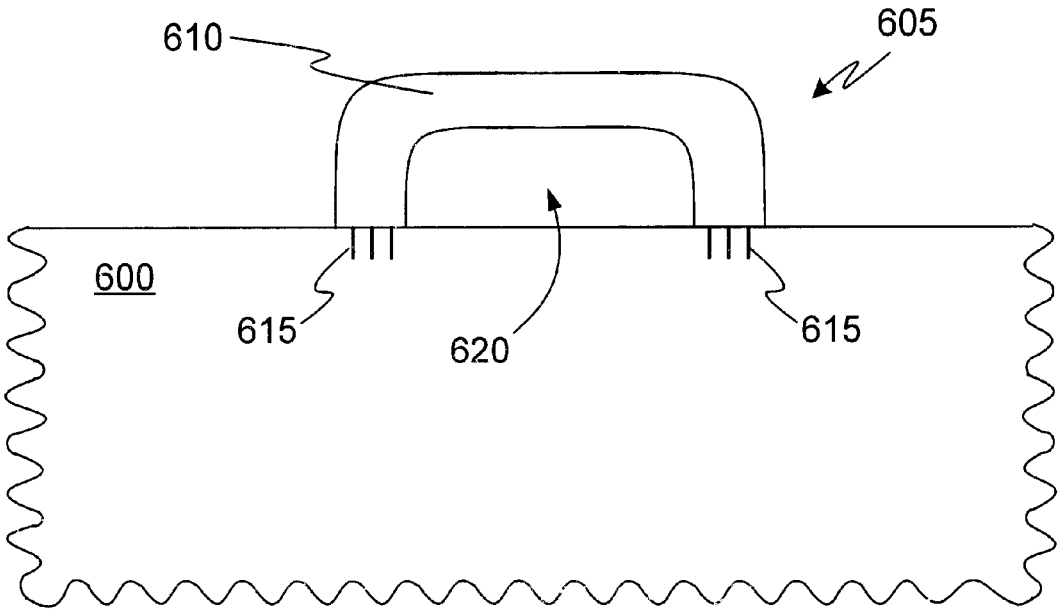
FIG. 6 illustrates a fourth towel-support mechanism.

FIG. 6 illustrates a towel-supporting mechanism 605 on a towel 600 in a fourth embodiment. In this embodiment, the towel-supporting mechanism 605 includes a loop 610 being disposed in a border region 215, being directed in the plane of the towel 600, and forming an aperture 620. The towel-supporting mechanism 605 also includes reinforcing stitching 615 for reinforcing the loop 610. It will be appreciated that, instead of reinforcing stitching 615, any soft reinforcing device, such as fabric, plastic, rubber or glue disposed about or adjacent to the loop 610, can additionally or alternatively be used.

Figure 7:
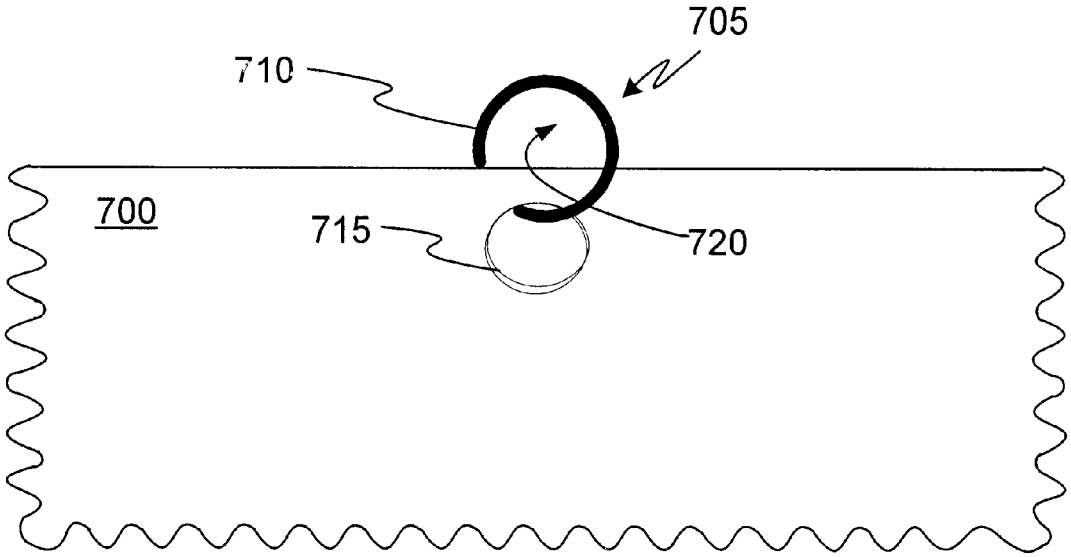
FIG. 7 illustrates a fifth towel-support mechanism.

FIG. 7 illustrates a towel-supporting mechanism 705 on a towel 700, in a fifth embodiment. In this embodiment, the towel-supporting mechanism 705 includes a loop 710 that loops through a hole 715 in the towel 700 and forms an aperture 720. The loop 710 is preferably made using the same fabric material as the towel 700. The towel-supporting mechanism 705 preferably includes a soft reinforcing device such as fabric, plastic, rubber, glue and/or stitching disposed about or adjacent the aperture 715 for reinforcing the aperture 715.

The foregoing description of the preferred embodiments of the present invention is by way of example only, and other variations and modifications of the above-described embodiments and methods are possible in light of the foregoing teaching. The embodiments described herein are not intended to be exhaustive or limiting. The present invention is limited only by the following claims.

What is claimed is:

1. A towel adapted to be supported on a hook, comprising:

a) a substantially rectangular absorbent towel body including first and second ends with opposed sides extending therebetween;

b) an elongated aperture extending through the towel body, said aperture extending parallel to an edge of the towel body at one of the ends and further being located at substantially a mid-portion between the opposed sides thereof; and c) an aperture reinforcing means for reinforcing the aperture in the towel body, said reinforcing means consisting essentially of:

i) a patch of fabric material overlying a surface of the towel body and including an elongated aperture aligned with and having the same shape as the aperture in the towel body; and ii) button-hole stitching located closely adjacent and extending about the apertures in the towel body and the fabric patch, wherein the reinforcing means is devoid of any rigid elements so that the towel is more suitable for drying or wiping sensitive surfaces and the apertures in the towel body and the reinforcing patch are sized to receive the hook so as to be supported thereon.

2. The towel of claim 1, further comprising additional fabric disposed adjacent the towel body and fabric patch apertures.

3. The towel of claim 1, wherein the towel body aperture is disposed in a design region of the towel.

4. The towel of claim 1, wherein the towel body aperture is disposed in a bulk region of the towel.

5. The towel of claim 1, wherein the towel body aperture is disposed in a border region of the towel.

* * * * *